US006452559B1

(12) United States Patent
Yuanzhu

(10) Patent No.: US 6,452,559 B1
(45) Date of Patent: Sep. 17, 2002

(54) CIRCULAR-POLARIZED-WAVE CONVERTER

(75) Inventor: Dou Yuanzhu, Fukushima-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 0 days.

(21) Appl. No.: 09/916,033

(22) Filed: Jul. 26, 2001

(30) Foreign Application Priority Data

Jul. 27, 2000 (JP) ..... 2000-227466
Aug. 7, 2000 (JP) ..... 2000-238771

(51) Int. Cl.[7] ..... H01Q 19/00
(52) U.S. Cl. ..... 343/756; 343/909; 333/21 A
(58) Field of Search ..... 343/756, 909; 333/21 A, 137

(56) References Cited

U.S. PATENT DOCUMENTS 3,955,202 A * 5/1976 Young ..... 343/756
5,948,718 A * 9/1999 Kanba et al. ..... 343/909
6,097,264 A * 8/2000 Vezmar ..... 333/21 A
6,118,412 A * 9/2000 Chen ..... 343/756

FOREIGN PATENT DOCUMENTS

JP 2000-286602 10/2000
JP 2001-068922 3/2001

* cited by examiner

*Primary Examiner*—Don Wong
*Assistant Examiner*—Hoang Nguyen
(74) *Attorney, Agent, or Firm*—Brinks Hofer Gilson & Lione

(57) ABSTRACT

A dielectric plate, serving as a 90-degree phase device, is disposed inside a waveguide. A phase-converting portion of uniform thickness is formed at the central portion of the dielectric plate, and stepped portions, serving as impedance converting portions, are formed at both longitudinal end portions of the phase converting portion by causing protrusions to be protrude from both of the longitudinal end portions. The protrusions are disposed on orthogonal axes extending in widthwise and thickness directions of the dielectric plate. The protruding amount of each of the protrusions from end surfaces of the phase converting portion is approximately ¼ of a wavelength λg inside the waveguide. The end surfaces of the phase converting portion and corresponding end surfaces of the protrusions form reflecting surfaces that are orthogonal to the direction of propagation of an electrical wave.

7 Claims, 7 Drawing Sheets

CIRCULAR-POLARIZED-WAVE CONVERTER

BACKGROUND OF THE INVENTION

1. Field of the Invention

The present invention relates to a circular-polarized-wave converter used in a transmitting-and-receiving device of, for example, a satellite broadcasting system.

2. Description of the Related Art

FIG. 11 is a sectional view of a conventionally known circular-polarized-wave converter. FIG. 12 is a left side view of the circular-polarized-wave converter. The conventional circular-polarized-wave converter shown in these figures comprises a circular cross-section waveguide 10 having a hollow inside portion, and a dielectric plate 11 secured to the inside wall surface of the waveguide 10. The dielectric plate 11 functions as a 90-degree-phase device. The dielectric plate 11 is formed of a dielectric material having a uniform thickness, and has V-shaped cutaway portions 11*a* at both ends thereof in a longitudinal direction thereof.

In the circular-polarized-wave converter having such a structure, the dielectric plate 11 can convert a circular polarized wave input to the waveguide 10 into a linearly polarized wave and output it, or, in contrast to this, can convert a linearly polarized wave input to the waveguide 10 into a circular polarized wave and output it. In other words, a circular polarized wave is a polarized wave in which a composite vector of two linearly polarized waves that have equal amplitudes and are 90 degrees out of phase rotates, so that, when, for example, a circular polarized wave is input to the inside of the waveguide 10, the phase difference of 90 degrees is eliminated by the dielectric plate 11, as a result of which the phases become the same, thereby making it possible to convert a right-hand circular polarized wave and a left-hand circular polarized wave into vertically polarized waves.

In the circular-polarized-wave converter having the above-described structure, the V-shaped cutaway portions 11*a* are formed as impedance converting portions at both longitudinal end portions of the dielectric plate 11, so that the reflection components at both ends of the dielectric plate 11 are reduced by the cutaway portions 11*a*, thereby making it possible to obtain proper input and out impedances. However, since the reflection components cannot be reduced unless tapering angles a (see FIG. 11) of the cutaway portions 11*a* with respect to a direction of propagation of an electrical wave are made small, lengths L of the impedance converting portions inevitably become large. This has been a serious factor in preventing size reduction of circular-polarized-wave converters. In addition, as shown in electrical field distributions illustrated in FIG. 13, when the dielectric plate 11 is set parallel to an electrical field E1, it is possible to match the impedances in an optimal state with respect to polarized waves in the directions of the electrical field E1 by adjusting the tapering angles a of the cutaway portions 11*a*. On the other hand, the impedances cannot be matched in an optimal state with respect to polarized waves in the directions of an electrical field E2, resulting in the problem that good low-reflection characteristics cannot be obtained.

Further, in the conventional circular-polarized-wave converter having the above-described structure, since a phase difference is produced by the length of the dielectric plate 11, serving as a 90-degree-phase device, the required length of the dielectric plate 11 is naturally determined. This has been a serious factor in preventing size reduction of circular-polarized-wave converters. Still further, in general, in this type of circular-polarized-wave converter, a required linearly polarized wave/circular polarized wave conversion can be performed in a frequency bandwidth where a phase difference $|\phi|$ falls within a range of 90°±10°. However, in the above-described conventional structure, the frequency bandwidth where the phase difference falls within the aforementioned range is a relatively narrow frequency bandwidth, so that the conventional circular-polarized-wave converter could not be used as a converter that operates using a wide frequency bandwidth.

SUMMARY OF THE INVENTION

Accordingly, in view of the actual state of such a conventional technology, it is an object of the present invention to provide a small suitable circular-polarized-wave converter in which a wide frequency bandwidth can be realized.

To this end, according to a first aspect of the present invention, there is provided a circular-polarized-wave converter comprising a waveguide having a hollow inside portion, and a 90-degree phase device disposed inside the waveguide. In the converter, the 90-degree phase device is a dielectric plate that includes an axial center of the waveguide and that extends in a direction within a plane parallel to the axial center of the waveguide. In addition, stepped portions are formed at both longitudinal end surfaces of the dielectric plate, are positioned on orthogonal axes extending in a widthwise direction and a thickness direction of the dielectric plate, and have two reflecting surfaces that are separated by approximately ¼ of a wavelength inside the waveguide along a direction of the axial center of the waveguide.

By virtue of this structure, since the phases of an electrical wave reflected by the two reflecting surfaces of the stepped portions are reversed and cancelled, the reflection components at the end portions of the dielectric plate are considerably reduced by the stepped portions, so that the overall length and, thus, the size of the dielectric plate can correspondingly be reduced. In addition, since the impedances can be matched in the optimal state with respect to the polarized waves in both directions of the electrical fields E1 and E2, it is possible to realize good low reflection characteristics.

The stepped portions may be protrusions formed at end surfaces of the dielectric plate, with a protruding amount of each of the protrusions being approximately ¼ of the wavelength inside the waveguide.

The stepped portions may be recesses formed in end surfaces of the dielectric plate, with a depth of each of the recesses being approximately ¼ of the wavelength inside the waveguide.

According to a second aspect of the present invention, there is provided a circular-polarized-wave converter comprising a waveguide having a hollow inside portion; a pair of ridges that are provided on an inside wall of the waveguide, and that are 180 degrees apart from each other so as to oppose each other via an axial center of the waveguide; and a dielectric plate that is held by the ridges. In the converter, a length of the dielectric plate and lengths of the ridges in a direction of the axial center of the waveguide are substantially the same.

In the circular-polarized-wave converter having such a structure, a phase difference occurs due to the ridges and the dielectric plate, disposed inside the waveguide, so that compared to circular-polarized-wave converters using a dielectric plate or ridges singly as a 90-degree phase device, the overall length can be considerably reduced. In addition, by combining the positive phase characteristic of the dielectric plate and the negative characteristic of each of the ridges, good converting characteristics can be achieved in a wide bandwidth frequency range.

The dielectric plate may be held by the ridges by fitting a protrusion and a recess. When the dielectric plate is fitted to each of the ridges through a recess or a protrusion, the dielectric plate can be disposed inside the waveguide with high precision, and the stability thereof can be increased.

When the circular-polarized-wave converter of the second aspect of the present invention is used or when the dielectric plate is held by the ridges by fitting a protrusion and a recess, stepped portions having two reflecting surfaces may be formed at both longitudinal end surfaces of the dielectric plate so as to be separated by approximately ¼ of a wavelength inside the waveguide. In these cases, the phases of an electrical wave reflected at the two reflecting surfaces of the stepped portions are reversed and cancelled. Therefore, the lengths of the impedance converting portions required at the end portions of the dielectric plate can be reduced, so that these structures are preferable from the viewpoint of reducing the size of the circular-polarized-wave converter.

DESCRIPTION OF THE PREFERRED EMBODIMENTS

Figure 1:
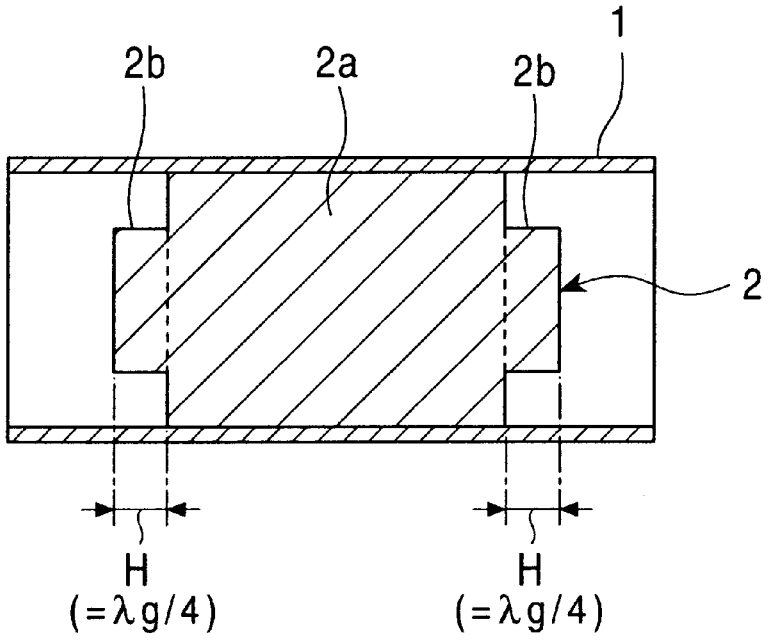
FIG. 1 is a sectional view of a first embodiment of a circular-polarized-wave converter in accordance with the present invention.
Figure 2:
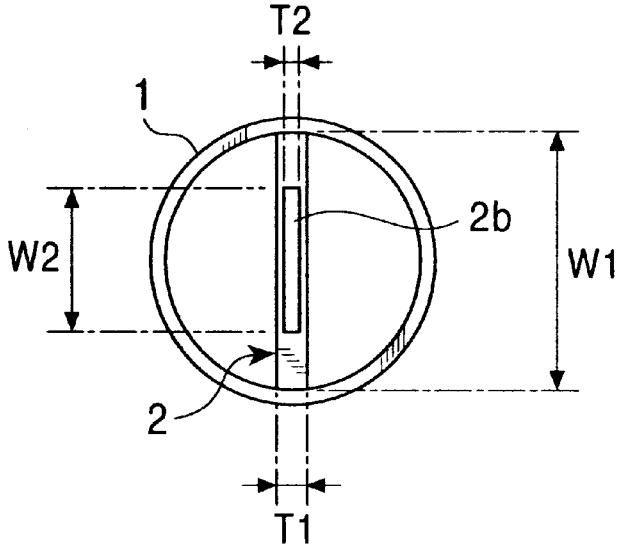
FIG. 2 is a left side view of the circular-polarized-wave converter.
Figure 3:
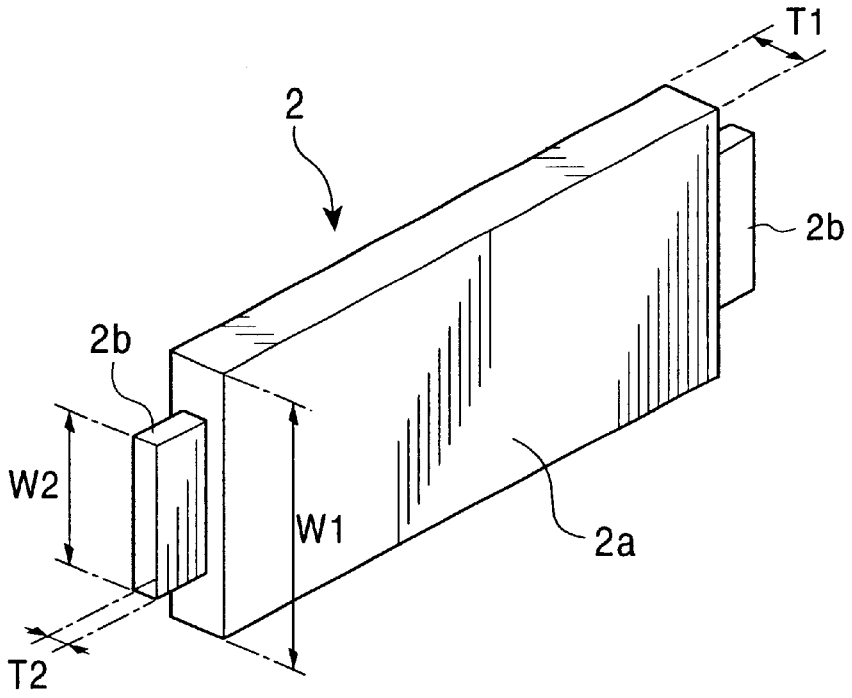
FIG. 3 is a perspective view of a dielectric plate of the circular-polarized-wave converter.

Hereunder, a description of a first embodiment of the present invention will be given with reference to the relevant figures. FIG. 1 is a sectional view of the first embodiment of a circular-polarized-wave converter in accordance with the present invention. FIG. 2 is a left side view of the circular-polarized-wave converter. FIG. 3 is a perspective view of a dielectric plate of the circular-polarized-wave converter.

As shown in these figures, the circular-polarized-wave converter of the first embodiment comprises a circular cross-section waveguide 1 having a hollow inside portion, and a dielectric plate 2 disposed inside the waveguide 1. The dielectric plate 2 is a 90-degree-phase device, formed of a dielectric material such as polyethylene. The central portion of the dielectric plate 2 is formed as a phase converting portion 2*a* having uniform thickness, with protrusions 2*b* being formed so as to protrude from both longitudinal ends of the phase converting portion 2*a*. These protrusions 2*b* form stepped portions serving as impedance converting portions. As is clear from FIG. 2, the protrusions 2*b* are positioned on orthogonal axes extending in widthwise and thickness directions of the dielectric plate 2. With the central portion of the dielectric plate 2 having a width W1 and a thickness T1, a width W2 of each protrusion 2*b* is less than the width W1 (W2<W1), and a thickness T2 of each protrusion 2*b* is less than the thickness T1 (T2<T1). When the amount of protrusion (that is, the height) of each protrusion 2*b* from its corresponding end surface of the phase converting portion 2*a* is represented by H, each H is set approximately ¼ of its corresponding wavelength λg inside the waveguide, so that the end surfaces of the phase converting portion 2*a* and end surfaces of the protrusions 2*b* are formed as reflecting surfaces that are orthogonal to the direction of propagation of an electrical wave. In other words, stepped portions of the aforementioned dielectric plate 2 comprise two reflecting surfaces that are separated by λg/4 along the direction of propagation of the electrical wave, so that these stepped portions form the impedance converting portions.

Figure 4:
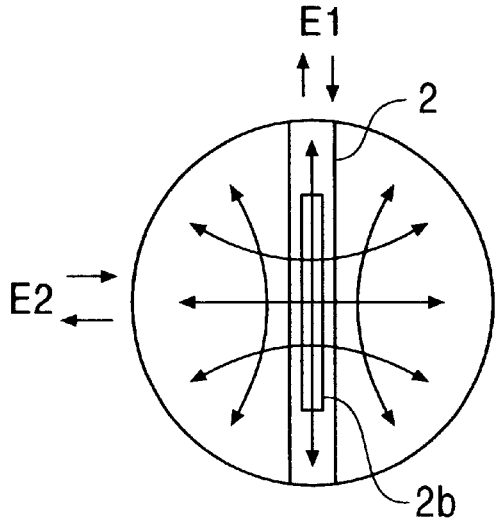
FIG. 4 illustrates electrical field distribution states of the circular-polarized-wave converter.

In the circular-polarized-light converter having such a structure, the dielectric plate 2 can convert a circular polarized wave input to the waveguide 1 into a linearly polarized wave and output it, or, in contrast to this, can convert a linearly polarized wave input to the waveguide 1 into a circular polarized wave and output it. Here, the end surfaces of the phase converting portion 2*a* and the corresponding end surfaces of the protrusions 2*b* are separated by λg/4 along the direction of propagation of an electrical wave, so that the phases of the electrical wave reflected by these end surfaces are reversed and cancelled, so that the reflection components at the end portions of the dielectric plate 2 are greatly reduced. Therefore, compared to the conventional technology where V-shaped tapering portions are used to form impedance converting portions, the stepped portions (protruding amount of the protrusions 2*b*), serving as impedance portions, can be greatly reduced in length, so that the overall length and, thus, the size of the dielectric plate 2 becomes correspondingly smaller. As is clear from the electrical field distributions shown in FIG. 4, both electrical fields E1 and E2 cross the protrusions 2*b* of the dielectric plate 2. Therefore, by properly adjusting the width W2 and the thickness T2 of each protrusion 2*b* as variants, the impedances can be matched in an optimal state with respect to polarized waves in both directions of the electrical fields E1 and E2, so that good lower reflection characteristics can be realized.

Figure 5:
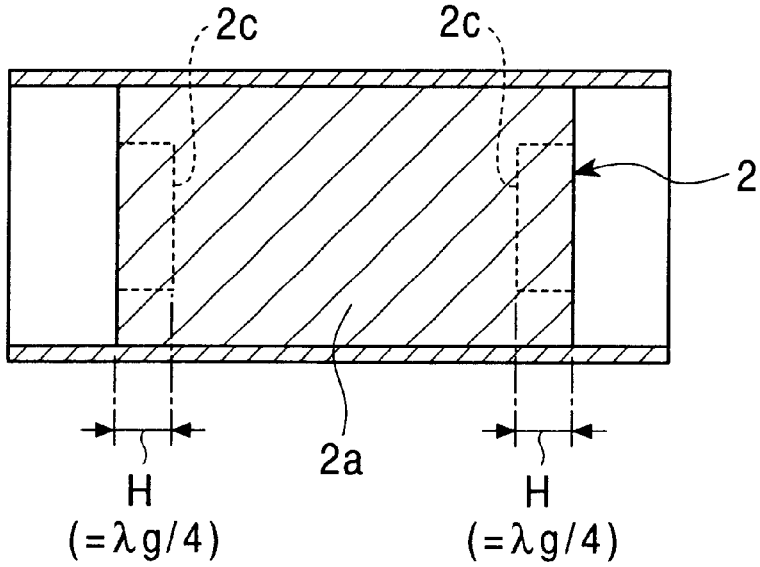
FIG. 5 is a sectional view of a second embodiment of a circular-polarized-wave converter in accordance with the present invention.
Figure 6:
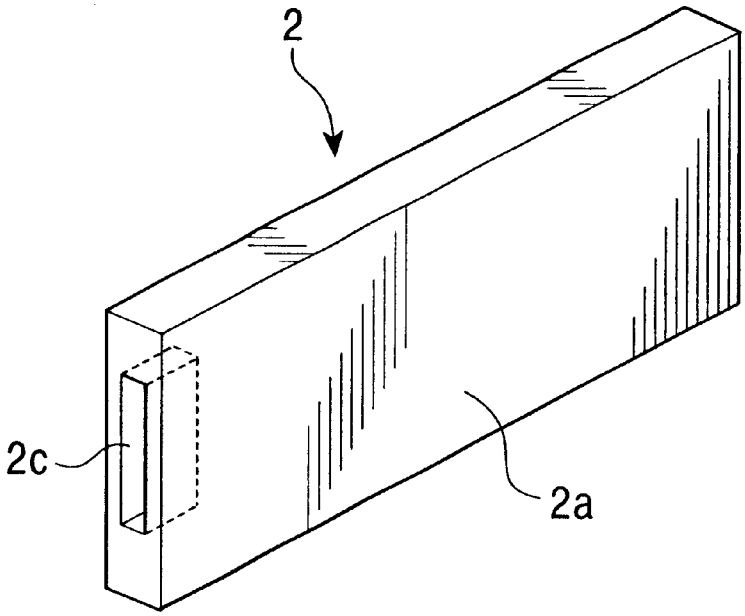
FIG. 6 is a perspective view of a dielectric plate used in the second embodiment of the circular-polarized-wave converter.

FIG. 5 is a sectional view of a second embodiment of a circular-polarized-wave converter in accordance with the present invention. FIG. 6 is a perspective view of a dielectric plate of the second embodiment of the circular-polarized-wave converter.

The second embodiment differs from the first embodiment in that recesses 2*c* are formed at both longitudinal end portions of a dielectric plate 2. and that these recesses 2*c* form stepped portions serving as impedance converting portions. The other structural features are basically the same. In other words, the recesses 2*c* are inverted forms of the protrusions 2*b* used in the first embodiment disposed within a plane orthogonal to an axial center of a waveguide 1. A depth H of each recess 2*c* is set at approximately ¼ of a wavelength kg inside the waveguide.

In the second embodiment of the circular-polarized-wave converter having such a structure, since the end surfaces of a phase converting portion 2*a* and end surfaces (inside bottom surfaces) of the recesses 2*c* are separated by λg/4 in the direction of propagation of an electrical wave, the phases of the electrical wave reflected at these end surfaces are reversed and cancelled, so that the reflection components can be greatly reduced at the end portions of the dielectric plate 2. Therefore, the overall length and, thus, the size of the dielectric plate 2 can be correspondingly reduced. Both electrical fields E1 and E2 cross the recesses 2*c* of the dielectric plate 2, so that, by properly adjusting a width W2 and a thickness T2 of each recess 2*c* as variants, the impedances can be matched in an optimal state with respect to polarized waves in both directions of the electrical fields E1 and E2, so that good low reflection characteristics can be obtained.

Figure 7:
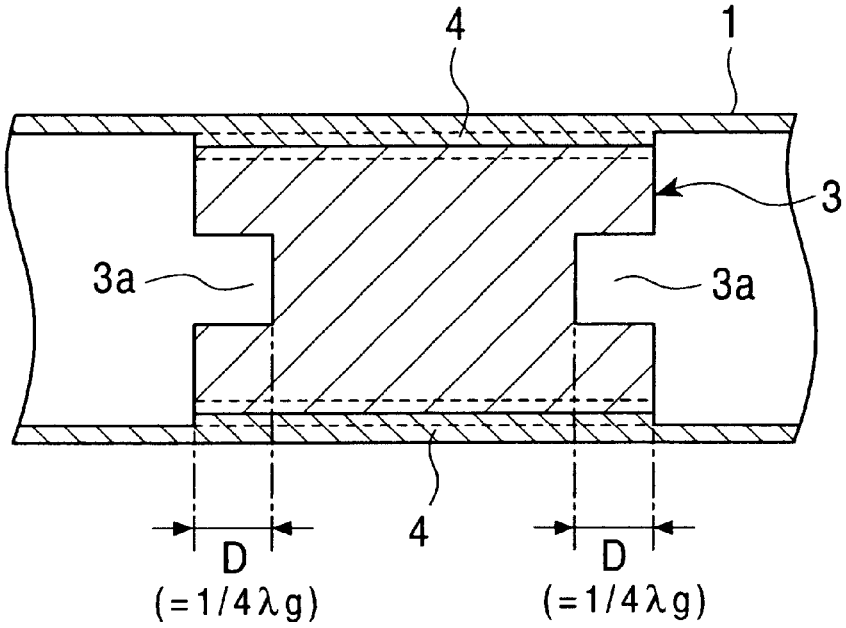
FIG. 7 is a sectional view of a third embodiment of a circular-polarized-wave converter in accordance with the present invention.
Figure 8:
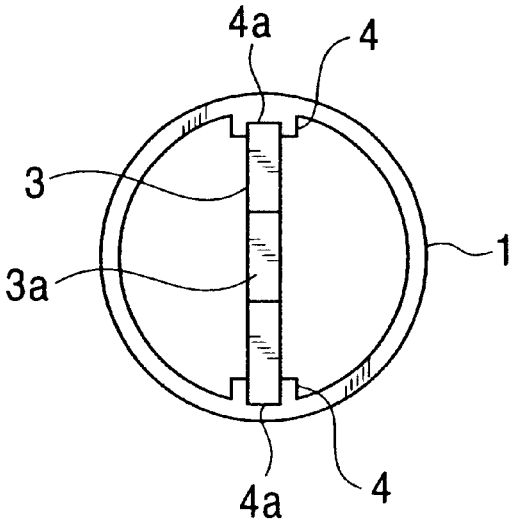
FIG. 8 is a left side view of the third embodiment of the circular-polarized-wave converter.

Next, a third embodiment of the present invention will be given with reference to the relevant drawings. FIG. 7 is a sectional view of a third embodiment of a circular-polarized-wave converter in accordance with the present invention. FIG. 8 is a left side view of the third embodiment of the circular-polarized-wave converter.

As shown in these figures, in the third embodiment of the circular-polarized-wave converter, a pair of ridges 4 are formed at the inside wall of a circular cross-section waveguide 1. A dielectric plate 3 is secured to these ridges 4. These ridges 4 are provided 180 degrees apart from each other so as to as to oppose each other via an axial center of the waveguide 1. Recessed grooves 4*a* are formed in the center portions of both ridges 4 along a longitudinal direction thereof. The dielectric plate 3 is a uniformly thick plate formed of a dielectric material such as polyethylene. By fitting both shorter-side ends of the dielectric plate 3 to the recessed grooves 4*a*, the dielectric plate 3 is secured to both ridges 4 inside the waveguide 1. Here, in an axial center direction of the waveguide 1, the lengths of the ridges 4 and the dielectric plate 3 are substantially the same, so that the dielectric plate 3 is such as not to protrude from the ridges 4, and viceversa. Rectangular cutaway portions 3*a* are formed in the center portions of both longitudinal ends of the dielectric plate 3. These cutaway portions 3*a* form stepped portions serving as impedance converting portions. A depth D of each cutaway portion 3*a* is set at approximately ¼ of a wavelength λg inside the waveguide. End surfaces of the dielectric plate 3 that are substantially the same as the ridges 4 and end surfaces (inside bottom surfaces) of the cutaway portions 3*a* are formed as reflecting surfaces that are orthogonal to the direction of propagation of an electrical wave. In other words, the stepped portions of the aforementioned dielectric plate 3 comprise two reflecting surfaces that are separated by λg/4 along the direction of propagation of an electrical wave. These stepped portions form the impedance converting portions.

Figure 9A:
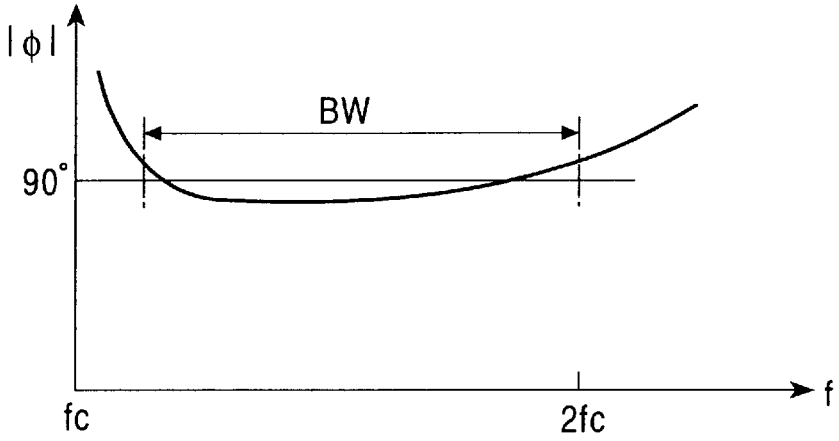
FIGS. 9A to 9C are graphs showing the frequency-phase characteristics in circular-polarized-wave converters.
Figure 9B:
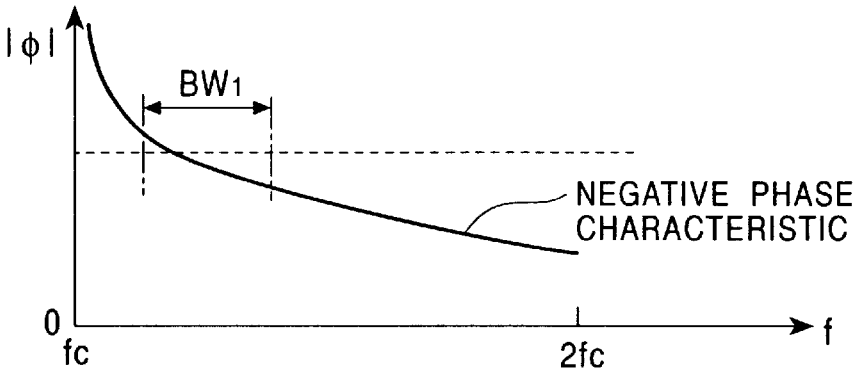
Figure 9C:
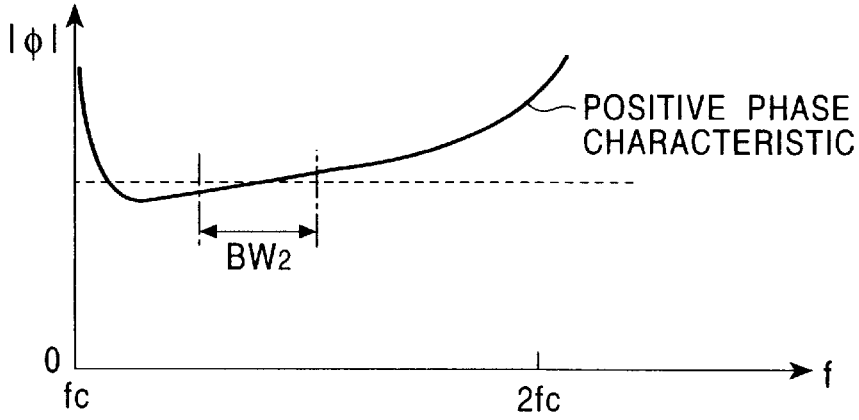

FIGS. 9A to 9C are graphs showing the frequency-phase characteristics in circular-polarized-wave converters. In these graphs, the horizontal axis shows the using frequency f, and the vertical axis shows the phase difference $|\phi|(=|\phi_V-\phi_H|$ expressed as an angle (°). X is a vertical polarized-wave phase of a polarized signal transmitted inside the waveguide, while ϕ is a horizontal polarized-wave phase of a polarized signal transmitted inside the waveguide.

First, the case where only the ridges 4 are disposed inside the waveguide 1 will be taken as a reference example. As shown in FIG. 9B, in a wide band frequency range between a frequency fc and a frequency 2 fc, as a frequency f increases from the frequency fc to the frequency 2 fc, the phase difference |ϕ| is decreased somewhat suddenly in a frequency range near the frequency fc. In the following frequency range, the phase difference |ϕ| is successively gradually reduced, and becomes equal to or less than 90 degrees while it is decreasing. Thereafter, the phase characteristic is such that the phase difference |ϕ| is similarly reduced. In this case, a frequency bandwidth $BW_1$ where the phase difference |ϕ| is within a range of 90°±10° is limited to a negligible portion of the frequency range between the frequency fc and the frequency 2 fc.

Next, the case where only the dielectric plate 3 is disposed inside the waveguide 1 will be taken as another reference example. As shown in FIG. 9C, in the wide band frequency range between the frequency fc and the frequency 2 fc, as the frequency f increases from the frequency fc to the frequency 2 fc, the phase difference |ϕ| is decreased suddenly in the frequency range near the frequency fc. When the phase difference |ϕ| is decreased to a value less than 90 degrees, it, then, successively increases. When the phase difference |ϕ| increases to a value greater than 90 degrees while it is increasing and reaches a value at a frequency range near the frequency 2 fc, the phase characteristic is such that the phase difference |ϕ| increases somewhat suddenly. Even in this case, a frequency bandwidth $BW_2$ where the phase difference |ϕ| falls within the range of 90°±10° is limited to a negligible portion of the frequency range between the frequency fc and the frequency 2 fc.

On the other hand, as shown in FIG. 9A, in the circular-polarized-wave converter comprising the ridges 4 and the dielectric plate 3 inside the waveguide 1, the phase characteristic is that obtained by a combination of a negative phase characteristic that successively increases as the frequency of the ridge structure increases (shown in FIG. 9B), and a positive phase characteristic that successively increases as the frequency of the dielectric plate structure increases (shown in FIG. 9C). In this case, a frequency bandwidth BW where the phase difference |ϕ| falls within the range of 90°±10° is a wide bandwidth that extends from near the frequency fc to the frequency 2 fc.

In this circular-polarized-wave converter of the above-described embodiment, the ridges 4 and the dielectric plate 3 can convert a circular polarized wave input to the waveguide 1 into a linearly polarized wave and output it, or, in contrast to this, can convert a linearly polarized wave input to the waveguide 1 into a circular polarized wave and output it. Here, since the values of the phase difference |ϕ| complement each other due to the ridges 4 and the dielectric plate 3, when a phase difference $\phi_1$ due to each of the ridges 4 and a phase difference $\phi_2$ due to the dielectric plate 3 is made to satisfy the relationship $\phi=\phi_1=\phi_2=90°$, and the lengths of the ridges 4 and the dielectric plate 3 are made substantially the same, it is possible to maximally reduce the overall length of the circular-polarized-wave converter. In addition, since, by combining the negative phase characteristic of each of the ridges 4 and the positive phase characteristic of the dielectric plate 3, the frequency bandwidth BW where the phase difference |ϕ| falls within the range of 90±10° can be made wide, good converting characteristics can be achieved in the wide bandwidth frequency range.

Further, since the dielectric plate 3 is fitted/secured to the recessed grooves 4*a* of the ridges 4, the dielectric plate 3 can be disposed inside the waveguide 1 with high precision, and the stability thereof can be increased. Still further, since the rectangular cutaway portions 3*a* are formed in both longitudinal end portions of the dielectric plate 3, and the depths D of the cutaway portions 3*a* are approximately ¼ of the wavelength λg inside the waveguide, the lengths of the impedance converting portions required at both end portions of the dielectric plate 3 can be reduced, so that, even in this respect, this structure is advantageous with regard to size reduction of circular-polarized-wave converters.

Figure 10A:
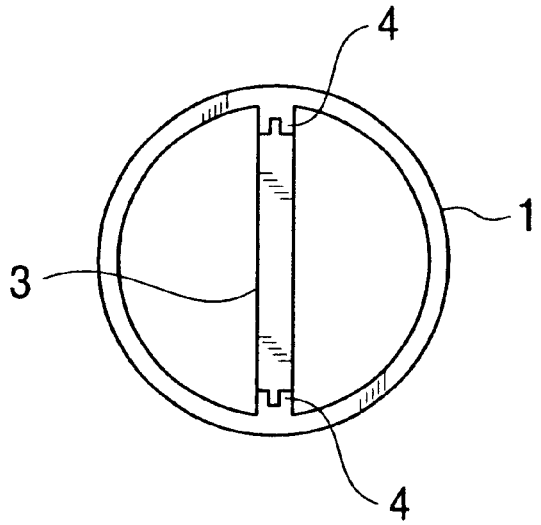
FIGS. 10A and 10B illustrate modifications of fitting the ridges and the dielectric plate through recesses and protrusions.
Figure 10B:
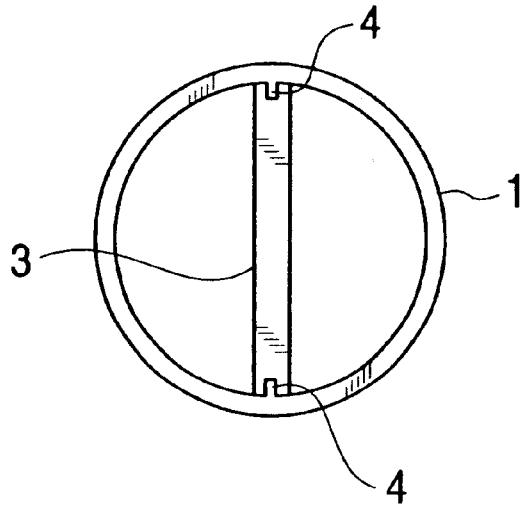
Figure 11:
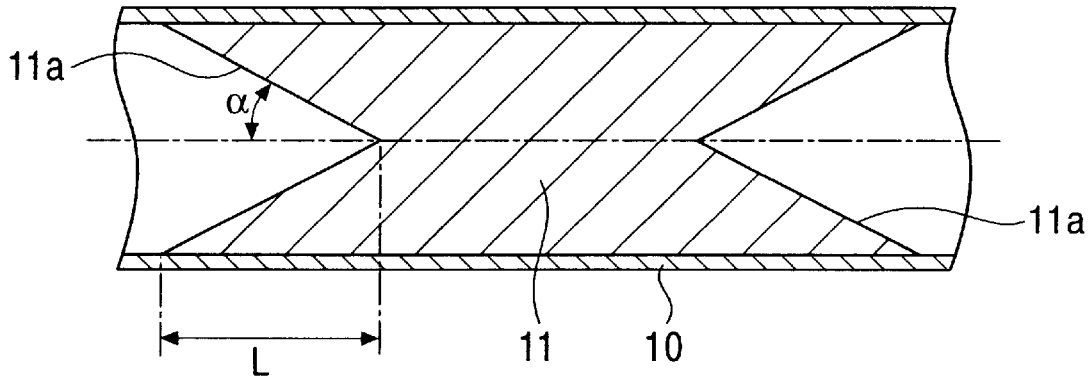
FIG. 11 PRIOR ART
FIG. 11 is a sectional view of a conventional circular-polarized-wave converter.
Figure 12:
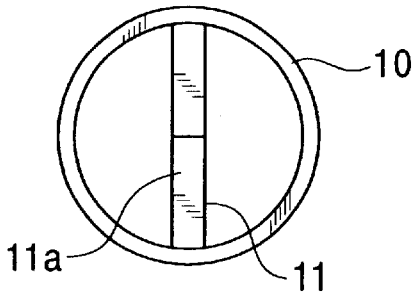
FIG. 12 PRIOR ART
FIG. 12 is a left side view of the conventional circular-polarized-wave converter.
Figure 13:
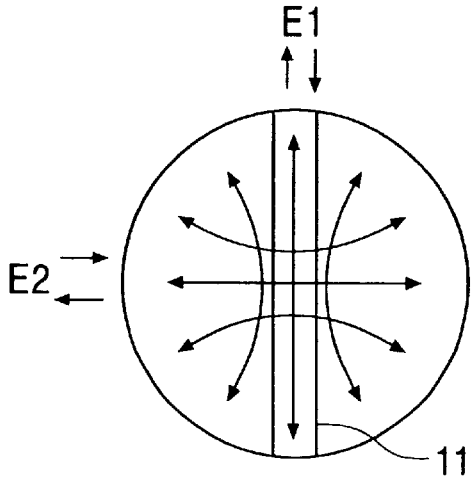
FIG. 13 PRIOR ART
FIG. 13 illustrates electrical field distribution states of the conventional circular-polarized-wave converter.

The fitting of the ridges 4 and the dielectric 3 through recesses/protrusions is not limited to that described in the above-described embodiment. For example, as shown in FIG. 10A, protrusions of the dielectric plate 3 can be fitted/secured to the recessed grooves of the ridges 4, or, as shown in FIG. 10B, recessed grooves of the dielectric plate 3 can be fitted/secured to the ridges 4.

Although in the above-described embodiment the cutaway portions 3*a* are used as impedance converting portions of the dielectric plate 3, other forms may be used. For example, although the overall length of the circular-polarized-wave converter becomes slightly longer than that of the above-described embodiment, V-shaped cutaway portions may be formed in both end portions of the dielectric plate 3 in order to fit the dielectric plate 3 to the ridges 4 through recesses/protrusions.

The present invention is carried out in the forms of the above-described embodiments, and provide the following advantages.

When stepped portions disposed on orthogonal axes extending in the widthwise and the thickness directions of the dielectric plate are formed at both longitudinal end surfaces of the dielectric plate, serving as a 90-degree phase device, and the two reflecting surfaces of the stepped portions are separated by approximately ¼ of the wavelength inside the waveguide along the axial direction of the waveguide, the phases of the electrical wave reflected at the two reflecting surfaces of the stepped portions are reversed and cancelled. Therefore, the reflection components at the end portions of the dielectric plate are greatly reduced by the stepped portions, so that the overall length and, thus, the size of the dielectric plate can correspondingly be made smaller. In addition, since the impedances can be matched in an optimal state with respect to polarized waves in both directions of the electrical fields E1 and E2, good low-reflection characteristics can be realized.

When the lengths of the pair of ridges, provided on the inner wall of the waveguide, and the length of the dielectric plate, held by these ridges, are substantially the same, a phase difference occurs due to the ridges and the dielectric plate. Therefore, compared to the circular-polarized-wave converter using a dielectric plate or ridges singly as a 90-degree phase device, the overall length can be considerably reduced. In addition, by combining the positive phase characteristic of the dielectric plate and the negative phase characteristics of the ridges, good converting characteristics can be achieved in a wide bandwidth frequency range. Therefore, it is possible to provide a circular-polarized-wave converter which is suitable for size reduction and which makes it possible to widen the frequency bandwidth.

What is claimed is:

1. A circular-polarized-wave converter comprising:

a waveguide having a hollow inside portion; and a 90-degree phase device disposed inside the waveguide;

wherein the 90-degree phase device is a dielectric plate that includes an axial center of the waveguide, the dielectric plate extending in a direction within a plane parallel to the axial center of the waveguide; and wherein stepped portions are formed at both longitudinal end surfaces of the dielectric plate, the stepped portions being positioned on orthogonal axes extending in a widthwise direction and a thickness direction of the dielectric plate, the stepped portions having two reflecting surfaces that are separated by approximately ¼ of a wavelength inside the waveguide along a direction of the axial center of the waveguide.

2. A circular-polarized-wave converter according to claim 1, wherein the stepped portions are protrusions that protrude from end surfaces of the dielectric plate, with a protruding amount of each of the protrusions being approximately ¼ of the wavelength inside the waveguide.

3. A circular-polarized-wave converter according to claim 1, wherein the stepped portions are recesses formed in end surfaces of the dielectric plate, with a depth of each of the recesses being approximately ¼ of the wavelength inside the waveguide.

4. A circular-polarized-wave converter comprising:

a waveguide having a hollow inside portion;

a pair of ridges provided on an inside wall of the waveguide, the pair of ridges being 180 degrees apart from each other so as to oppose each other via an axial center of the waveguide; and a dielectric plate that is held by the ridges;

wherein a length of the dielectric plate and lengths of the ridges in a direction of the axial center of the waveguide are substantially the same.

5. A circular-polarized-wave converter according to claim 4, wherein the dielectric plate is held by the ridges by fitting a protrusion and a recess.

6. A circular-polarized-wave converter according to claim 5, wherein stepped portions are formed at both longitudinal end surfaces of the dielectric plate, the stepped portions having two reflecting surfaces that are separated by approximately ¼ of a wavelength inside the waveguide.

7. A circular-polarized-wave converter according to claim 4, wherein stepped portions are formed at both longitudinal end surfaces of the dielectric plate, the stepped portions having two reflecting surfaces that are separated by approximately ¼ of a wavelength inside the waveguide.

* * * * *